US009031272B2

(12) United States Patent
Schumaier

(10) Patent No.: US 9,031,272 B2
(45) **Date of Patent: *May 12, 2015**

(54) HEARING ASSISTANCE APPARATUS HAVING SINGLE MULTIPURPOSE CONTROL DEVICE AND METHOD OF OPERATION

(71) Applicant: Daniel R. Schumaier, Elizabethton, TN (US)

(72) Inventor: Daniel R. Schumaier, Elizabethton, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/322,963

(22) Filed: Jul. 3, 2014

(65) Prior Publication Data

US 2014/0321684 A1 Oct. 30, 2014

Related U.S. Application Data

(63) Continuation of application No. 13/663,743, filed on Oct. 30, 2012, now Pat. No. 8,811,642, which is a continuation-in-part of application No. 12/420,477, filed on Apr. 8, 2009, now Pat. No. 8,396,237.

(51) Int. Cl.
*H04R 25/00* (2006.01)

(52) U.S. Cl.
CPC ..... *H04R 25/65* (2013.01); *H04R 25/70* (2013.01); *H04R 2225/39* (2013.01); *H04R 2225/61* (2013.01); *H04R 25/407* (2013.01)

(58) Field of Classification Search
CPC ..... H04R 25/65; H04R 25/70; H04R 25/407; H04R 2225/39; H04R 2225/61
USPC ..... 381/322, 324; 715/727
See application file for complete search history.

(56) References Cited

U.S. PATENT DOCUMENTS

| | | | |
|---|---|---|---|
| 4,471,171 | A | 9/1984 | Kopke et al. |
| 4,887,299 | A | 12/1989 | Cummins et al. |
| 4,972,487 | A | 11/1990 | Mangold et al. |
| 5,012,520 | A | 4/1991 | Steeger |

(Continued)

FOREIGN PATENT DOCUMENTS

| | | | |
|---|---|---|---|
| EP | 1261235 | A2 | 11/2002 |
| EP | 1363473 | A2 | 11/2003 |

(Continued)

OTHER PUBLICATIONS

Harvey Dillon, Ph.D., Prescribing Hearing Aid Performance, 2001, Chapter 9, pp. 234-239.

*Primary Examiner* — Jesse Elbin
(74) *Attorney, Agent, or Firm* — Luedeka Neely Group, P.C.

(57) ABSTRACT

A hearing assistance device has one multipurpose control device that operates in an algorithm selection mode and a daily use mode. In the algorithm selection mode, the multipurpose control device is used to switch between amplification algorithms and select one of the algorithms to be implemented in an audio processing program. In the daily use mode, the multipurpose control device is used to adjust the volume of sound generated by an audio output section. A battery compartment door of the device has an open position in which the device is powered off, and a closed position in which the device is powered on. The multipurpose control device and the battery compartment door are the only user-operable controls on the hearing assistance device for controlling the device and powering the device on or off. No other controls are needed for adjusting volume, selecting algorithms, and switching between and selecting programs.

7 Claims, 3 Drawing Sheets

(56) References Cited

U.S. PATENT DOCUMENTS

| | | | | |
|---|---|---|---|---|
| 6,035,050 | A | 3/2000 | Weinfurtner et al. | |
| 6,104,822 | A | 8/2000 | Melanson et al. | |
| 6,674,867 | B2 | 1/2004 | Basseas | |
| 6,682,472 | B1 | 1/2004 | Davis | |
| 6,741,712 | B2 | 5/2004 | Bisgaard | |
| 6,748,089 | B1 | 6/2004 | Harris et al. | |
| 6,785,394 | B1 | 8/2004 | Olsen et al. | |
| 6,829,363 | B2 | 12/2004 | Sacha | |
| 7,106,870 | B2 | 9/2006 | Meier et al. | |
| 7,269,269 | B2 | 9/2007 | Hamacher et al. | |
| 8,526,646 | B2 * | 9/2013 | Boesen | 381/312 |
| 2002/0015506 | A1 | 2/2002 | Aceti et al. | |
| 2004/0240693 | A1 | 12/2004 | Rosenthal | |
| 2005/0031145 | A1 | 2/2005 | Maltan et al. | |
| 2005/0111680 | A1 | 5/2005 | Meier et al. | |
| 2006/0029244 | A1 | 2/2006 | Niederdrank | |
| 2007/0076909 | A1 | 4/2007 | Roeck et al. | |
| 2007/0079692 | A1 | 4/2007 | Glatt | |
| 2008/0170731 | A1 | 7/2008 | Wojas | |
| 2009/0196448 | A1 | 8/2009 | Schumaier | |
| 2010/0054510 | A1 | 3/2010 | Schumaier | |

FOREIGN PATENT DOCUMENTS

| | | | |
|---|---|---|---|
| EP | 1601232 | B1 | 4/2008 |
| WO | 9607295 | A1 | 3/1996 |
| WO | 03045108 | A2 | 5/2003 |
| WO | 03061341 | A2 | 7/2003 |

* cited by examiner

HEARING ASSISTANCE APPARATUS HAVING SINGLE MULTIPURPOSE CONTROL DEVICE AND METHOD OF OPERATION

RELATED APPLICATIONS

This application is a continuation of U.S. patent application Ser. No. 13/663,743 filed Oct. 30, 2012, entitled "Hearing Assistance Apparatus Having Single Multipurpose Control Device and Method of Operation," which is continuation-in-part of and claims priority to U.S. Pat. No. 8,396,237, entitled "Preprogrammed Hearing Assistance Device with Program Selection Using a Multipurpose Control Device," the entire contents of which are incorporated herein by reference.

FIELD

This invention relates to the field of hearing assistance devices, including personal sound amplification products (PSAPs) and hearing aids. More particularly, this invention relates to a system for operating a PSAP or hearing aid using a multipurpose control device.

BACKGROUND

Hearing loss varies widely from patient to patient in type and severity. As a result, the acoustical characteristics of a hearing aid must be selected to provide the best possible result for each hearing impaired person. Typically, these acoustical characteristics of a hearing aid are "fit" to a patient through a prescription procedure. Generally, this has involved measuring hearing characteristics of the patient and calculating the required amplification characteristics based on the measured hearing characteristics. The desired amplification characteristics are then programmed into a digital signal processor in the hearing aid, the hearing aid is worn by the patient, and the patient's hearing is again evaluated while the hearing aid is in use. Based on the results of the audiometric evaluation and/or the patient's comments regarding the improvement in hearing, or lack thereof, an audiologist or dispenser adjusts the programming of the hearing aid to improve the result for the patient.

As one would expect, the fitting procedure for a hearing aid is generally an interactive and iterative process, wherein an audiologist or dispenser adjusts the programming of the hearing aid, receives feedback from the patient, adjusts the programming again, and so forth, until the patient is satisfied with the result. In many cases, the patient must evaluate the hearing aid in various real world situations outside the audiologist's or dispenser's office, note its performance in those situations and then return to the audiologist or dispenser to adjust the hearing aid programming based on the audiologist's or dispenser's understanding of the patient's comments regarding the patient's experience with the hearing aid.

One of the significant factors in the price of a hearing aid is the cost of the audiologist's or dispenser's services in fitting and programming the device, along with the necessary equipment, such as software, computers, cables, interface boxes, etc. If the required participation of the audiologist and/or dispenser and the fitting equipment can be eliminated or at least significantly reduced, the cost of a hearing aid can be significantly reduced.

Some people, though not hearing impaired, from time to time need amplification of sounds in their environment for a number of reasons, such as while performing recreational activities. These people do not need a hearing aid that requires a "fitting" procedure performed by an audiologist. Rather, these people need a personal sound amplification product (PSAP). Although PSAPs have been available for many years, prior PSAP's have provided few options, if any, for selecting a gain-frequency response that is a good fit for the wearer's hearing situation.

What is needed, therefore, is a programmable hearing assistance device that does not require a fitting procedure conducted by an audiologist or dispenser. To obviate the necessity of the programming equipment and the necessity of an audiologist or dispenser fitting procedure, a programmable hearing assistance device is needed that can be automatically programmed based on selections made by a user while using the device.

Also needed is an easy-to-operate PSAP that allows a wearer to evaluate and choose a best-fit gain-frequency response.

SUMMARY

The above and other needs are met by a hearing assistance device for enhancing hearing for a user. In a preferred embodiment, the device includes a housing configured to be worn in, on or behind an ear of the user. The housing contains one or more microphones, a memory, a processor, a single multipurpose control device, a digital-to-analog converter, an audio output section and a battery compartment door. The memory stores multiple amplification algorithms and multiple audio processing programs for use in processing digital audio signals. The processor uses the amplification algorithms while executing the audio processing programs to process the digital audio signals.

The multipurpose control device has only one up control and only one down control and operates in an algorithm selection mode and a daily use mode. In the algorithm selection mode, the user presses the up control or down control of the multipurpose control device to switch from one to another of the amplification algorithms, and to select one of the algorithms to be a preferred algorithm. In the daily use mode, the user presses the up control or down control of the multipurpose control device to adjust the volume of audible sound generated by an audio output section.

The battery compartment door holds a battery that powers the hearing assistance device. The battery compartment door has an open position in which the battery is removed from the device and the device is powered off, and a closed position in which the battery is inserted into the device and the device is powered on.

The single multipurpose control device and the battery compartment door are the only user-operable controls on the hearing assistance device for controlling the device and powering the device on or off. No other controls are needed for adjusting volume and switching between and selecting algorithms and programs.

In another aspect, the invention provides a method for controlling a hearing assistance device having a multipurpose control device. The method includes the following steps:

(a) The user inserts a battery to power on the hearing assistance device, such as by closing the battery compartment door with the battery in place.

(b) Upon initial power on, a processor of the hearing assistance device uses one of multiple amplification algorithms stored in memory.

(c) The user listens to audible sound generated by an audio output section as the processor processes the digital audio signals.

(d) The user taps the up control or down control of the multipurpose control device one time.

(e) Upon performance of step (d), the processor ceases use of one of the amplification algorithms and initiates use of another of the amplification algorithms.

(f) Steps (c), (d) and (e) are repeated until the user determines that one of the amplification algorithms is a preferred algorithm.

(g) The user presses and holds the up control or down control for an extended period of time, such as ten seconds.

(h) Upon performance of step (g), the processor implements the preferred algorithm in one of the audio processing programs. After performance of step (g), all other audio processing programs are unavailable for use.

(i) After performance of step (g), the user taps the up control a number of times.

(j) Upon performance of step (i), the volume of audible sound generated by the audio output section is increased according to the number of times the up control is tapped, such as by one to five decibels.

(k) After performance of step (g), the user taps the down control a number of times.

(l) Upon performance of step (k), the volume of audible sound generated by the audio output section is decreased according to the number of times the down control is tapped.

In some preferred embodiments, upon performance of step (e), the audio output section generates some number of audible tones or other sounds to identify the amplification algorithm in use.

In some preferred embodiments, upon performance of step (h), the audio output section generates an audible tone indicating that the preferred algorithm has been implemented for continued use.

In some preferred embodiments, the audio processing program implemented in step (h) is a quiet audio processing program configured for use in quiet acoustical environments, and the method further includes the following additional steps:

(m) Upon performance of step (g), a noise audio processing program configured for use in noisy acoustical environments and a telecoil audio processing program configured for use when the user is listening to a telephone are made available.

(n) After performance of step (h), the user presses and holds the up control or the down control for an extended period of time, such as two seconds.

(o) Upon performance of step (n), the processor discontinues use of the quiet audio processing program and initiates use of the noise audio processing program.

(p) After performance of step (o), the user again presses and holds the up control or the down control for an extended period of time, such as two seconds.

(q) Upon performance of step (p), the processor discontinues use of the noise audio processing program and initiates use of the telecoil audio processing program.

(r) After performance of step (q), the user again presses and holds the up control or the down control for an extended period of time, such as two seconds.

(s) Upon performance of step (r), the processor discontinues use of the telecoil audio processing program and initiates use of the quiet audio processing program.

In some preferred embodiments, two microphones are used in conjunction with the noise audio processing program to provide an enhanced directional response for noisy environments, and only one microphone is used in conjunction with the quiet audio processing program to provide an omnidirectional response for quiet environments.

In some preferred embodiments, the audio output section generates an audible noise-like sound indicating that the noise audio processing program has been selected, a dial tone indicating that the telecoil audio processing program has been selected, and an audible tone indicating that the quiet audio processing program has been selected.

In some preferred embodiments, the method includes a reset procedure having the following steps:

(m) The user removes the battery to power off the hearing assistance device, such as by opening the battery compartment door with the battery in place.

(n) The user reinserts the battery to power on the hearing assistance device, such as by closing the battery compartment door with the battery in place.

(o) While performing step (n), the user presses and holds the up control or the down control for an extended period of time, such as fifteen seconds.

(p) After performing step (o), the user releases the up control or down control and removes the battery to power down the hearing assistance device.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
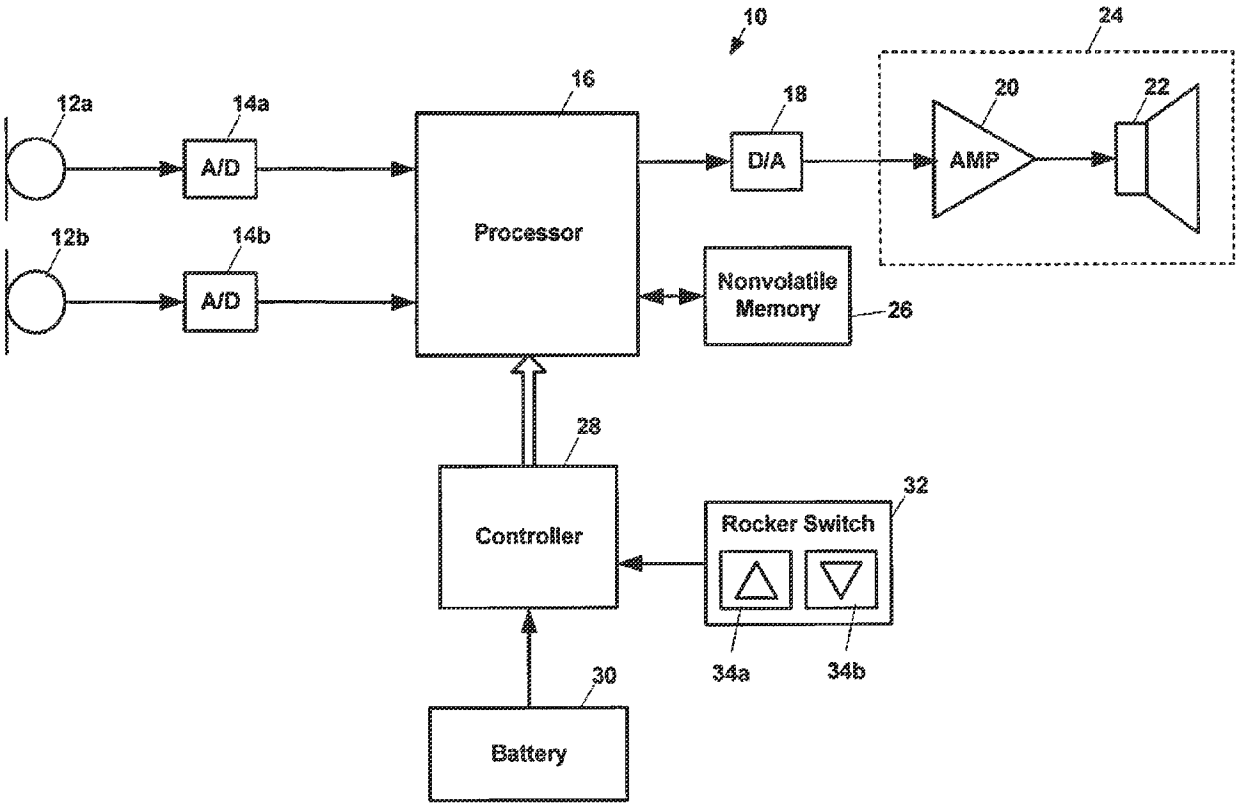
FIG. 1 depicts a functional block diagram of a personal hearing assistance device according to an embodiment of the invention.
Figure 3:
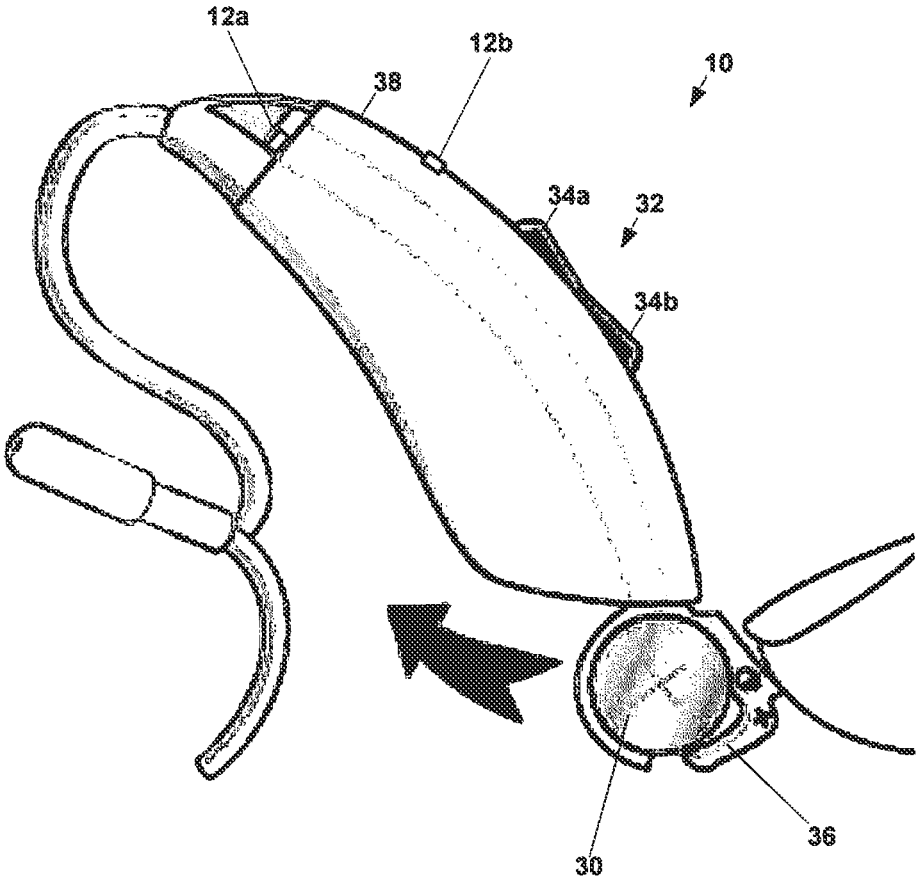
FIG. 3 depicts the physical configuration of a personal hearing assistance device according to an embodiment of the invention.

FIGS. 1 and 3 depict a preferred embodiment of a personal hearing assistance device 10 for amplifying ambient sound. The device 10 preferably includes two microphones 12*a*-12*b* for sensing sound and converting the sound to analog audio signals. The analog audio signals generated by the microphones 12*a-b* are converted to digital audio signals by analog-to-digital (A/D) converters 14*a*-14*b*. The digital audio signals are processed by a digital processor 16 to shape the frequency envelope of the digital audio signals to enhance those signals in a way which will improve audibility for a wearer of the device 10. Further discussion of various programs for processing the digital audio signals by the processor 16 is provided below. Thus, the processor 16 generates digital audio signals that are modified based on the programming of the processor 16. The modified digital audio signals are provided to a digital-to-analog (D/A) converter 18 which generates analog audio signals based on the modified digital audio signals. The analog audio signals at the output of the D/A converter 18 are amplified by an audio amplifier 20, where the level of amplification is controlled by a control device 32, such as a rocker switch, coupled to a controller 28. The amplified audio signals at the output of the amplifier 20 are provided to a sound generation device 22, which may be an audio speaker or other type of transducer that generates sound waves or mechanical vibrations that the wearer perceives as sound. The amplifier 20 and sound generation device 22 are referred to collectively herein as an audio output section 24 of the device 10.

In a preferred embodiment, the control device 32 comprises a digital rocker switch mounted on an outer surface of a housing 38 of the device 10. For example, the digital rocker switch 32 may be a model number MT90 Momentary Toggle Switch manufactured by Sonion. In some embodiments, the control device 32 comprises two individual push button switches disposed in a single rocker-style switch housing. Both of these control device configurations are referred to herein as a digital rocker switch and both include "up" and "down" controls 34*a* and 34*b*. The digital rocker switch 32 is also referred to herein as a multipurpose control device because it may be used as a volume control and as a control for switching between and selecting audio processing programs. As depicted in FIG. 3, the preferred embodiment has no control devices other than the rocker switch 32 for performing these functions. As described in more detail below, the rocker switch 32 may be used in conjunction with closure of the battery compartment door 36 to reset the device 10.

The device 10 may be configured as a behind-the-ear (BTE) instrument, with the rocker switch 32 located on an accessible surface of the housing 38 of the BTE instrument as shown in FIG. 3. However, it will be appreciated that the invention is not limited to any particular configuration of the device 10. In various embodiments, the device 10 may comprise an open fit device, an ear canal device, a half-shell configuration, a BTE device, an in-the-ear (ITE) device or a completely in canal (CIC) device.

Nonvolatile memory 26, such as read-only memory (ROM), programmable ROM (PROM), electrically erasable PROM (EEPROM), or flash memory, is provided for storing programming instructions and other operational parameters for the device 10. Preferably, the memory 26 is accessible by the processor 16 and/or the controller 28.

According to preferred embodiments of the invention, the personal sound amplification device 10 is operable in several different modes as determined by its programming. As the terms are used herein, "programs" and "programming" refers to one or more sets of instructions or parameters that are carried out or used by the processor 16 in shaping the frequency envelope of digital audio signals to enhance those signals to improve audibility for the wearer of the device 10. "Programs" and "programming" also refers to the instructions carried out by the processor 16 in determining which of several stored enhancement programs provides the best improvement for the wearer.

As used herein, a program is a set of instructions that implement an amplification algorithm for setting the audio frequency shaping or compensation provided in the processor 16. The amplification algorithms may also be referred to as "gain-frequency response" algorithms. Examples of generally accepted gain-frequency response algorithms include NAL (National Acoustic Laboratories; Bryne & Tonisson, 1976), Berger (Berger, Hagberg & Rane, 1977), POGO (Prescription of Gain and Output; McCandless & Lyregaard, 1983), NAL-R (NAL-Revised; Byrne & Dillon, 1986), POGO II (Schwartz, Lyregaard & Lundh, 1988), NAL-RP (NAL-Revised, Profound; Byrne, Parkinson & Newall, 1991), FIG6 (Killion & Fikret-Pasa, 1993) and NAL-NL1 (NAL nonlinear; Dillon, 1999). It will be appreciated that other algorithms could be used in association with the methods described herein, and the above list should not be construed as limiting the scope of the invention in any way.

In the preferred embodiment of the invention, a feedback canceller algorithm is also stored in the memory 26 of the device 10. An example of a feedback canceller algorithm is described in U.S. Patent Application Publication 2005/0047620 by Robert Fretz. As described in more detail below, such an algorithm is used to set the acoustical gain levels in the processor 16 and/or the amplifier 20 to avoid audio feedback in the device 10.

Figure 2:
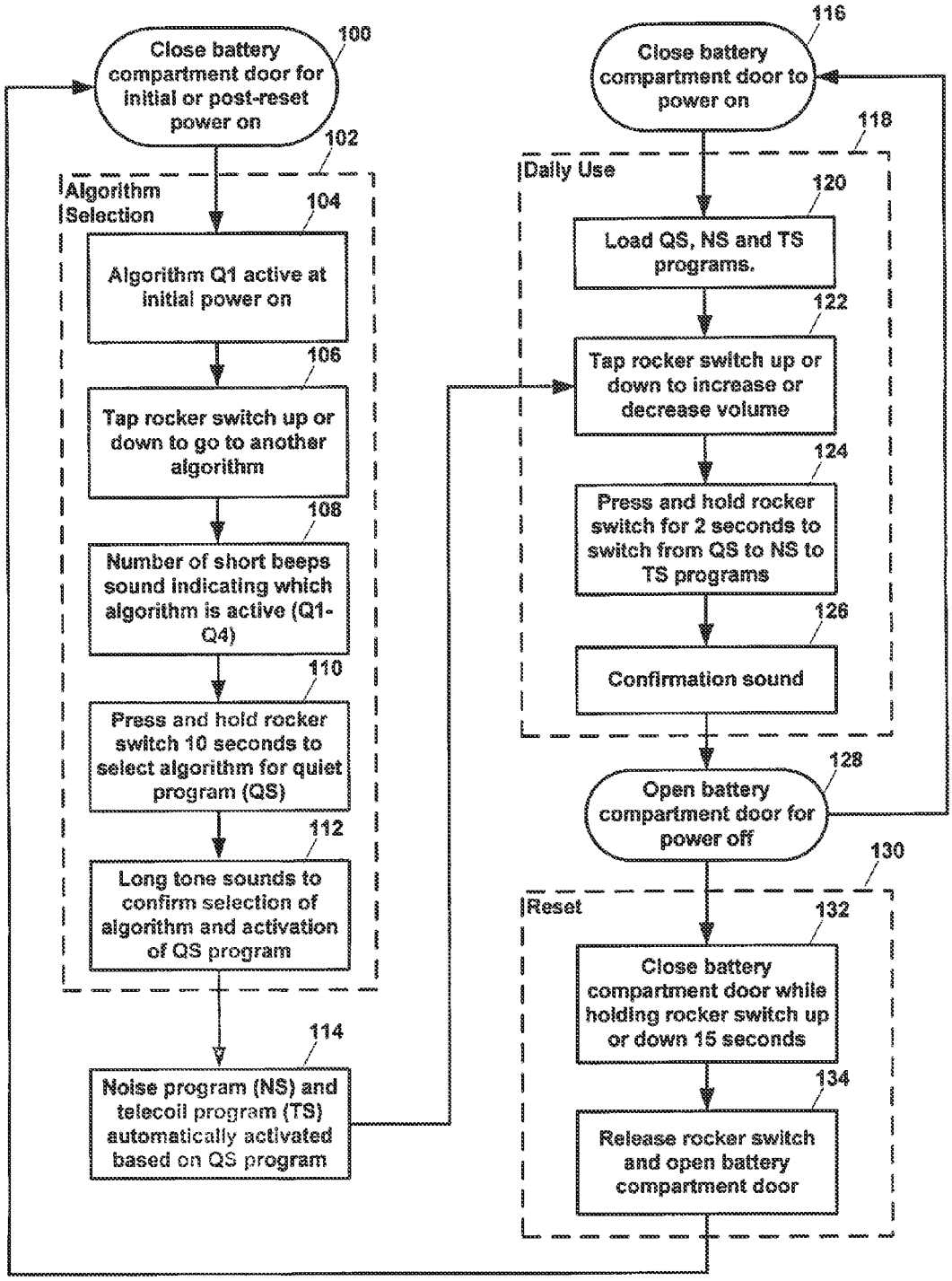
FIG. 2 depicts a functional flow diagram of the operation of a personal hearing assistance device according to an embodiment of the invention.

In a preferred embodiment of the invention, the rocker switch 32 is used to select preferred quiet environment programs during a setup procedure, to switch between a quiet environment program, noisy environment program and telecoil program during daily use, to control audio volume during daily use, and to reset the device 10. FIG. 2 depicts a functional flow diagram which describes how the up and down controls 34*a*-34*b* of the rocker switch 32 may be so used in one embodiment.

As shown in FIG. 2, when the device 10 is powered on for the first time or after a reset (step 100), such as by inserting a battery and closing the battery compartment door 36 (FIG. 3), the processor 16 (FIG. 1) enters an algorithm selection mode 102. In preferred embodiments, four amplification algorithms Q1-Q4 are available to try in this mode. It will be appreciated that more or fewer amplification algorithms may be available in alternative embodiments of the invention. When the device 10 is powered on for the first time or after a reset, the amplification algorithm Q1 having the lowest amplification setting is active (step 104).

To cycle through the other available algorithms, the user taps the rocker switch up control 34*a* or down control 34*b* (step 104). As the term is used in describing preferred embodiments herein, a "tap" of the rocker switch is a press/hold of less than two seconds in duration.

When switching from one algorithm to the next, the audio output section 19 emits an auditory indicator of the active algorithm, such as some number of short pure-tone beeps indicating the number of the algorithm (step 108). The user can select the preferred one of the algorithms Q1-Q4 to be implemented in a quiet audio processing program (QS) by pressing and holding the rocker switch up control 34*a* or down control 34*b* for some extended time, such as ten seconds (step 110). At this point a long tone sounds to indicate to the user that the QS program is active (step 112).

Once the QS program is active, the non-selected algorithms are deactivated. In preferred embodiments, the non-selected algorithms are not erased, but are available for reactivation by resetting the device as described hereinafter.

In a preferred embodiment, when the QS program is selected, a single one of the microphones 12*a*-12*b* is used, thereby providing a substantially omnidirectional sound pattern that is optimal for relatively quiet conditions.

The processor 16 automatically activates a noisy environment condition program (NS) based on the QS program (step 114). When the NS program is selected, both of the microphones 12*a*-12*b* are used, thereby providing a more directional sound pattern that is optimal for relatively noisy conditions. In preferred embodiments, the shape of the gain/frequency response curve of the NS program is similar to that of the selected QS program. In some embodiments, the NS program has a reduced low-frequency response as compared to the QS program. The processor 16 also automatically selects a telecoil program TS based on the program QS.

Once the QS, NS and TS programs are active, the processor 16 enters a daily use mode (step 118). While in the daily use mode, the user can increase the audio volume by tapping the rocker switch up control 34*a* and decrease the audio volume by tapping the rocker switch down control 34*b*, with each tap increasing or decreasing the volume incrementally (step 122). The user can switch between the QS, NS and TS programs by pressing and holding the rocker switch up control 34*a* or down control 34*b* for about two seconds (step 124). When the QS program is selected, a pure-tone beep or other distinct sound is emitted from the audio output section 24 (step 126). When the NS program is selected, a noise sound ("shhh") is emitted. When the TS program is selected, a dial-tone pulse is emitted.

To turn off the device 10, the user opens the battery compartment door 36 (step 128). To turn the device 10 back on, the user closes the battery compartment door 36 (step 116) as depicted by the arrow in FIG. 3. When the device 10 is powered on after an algorithm selection routine (102) has been completed (and no reset has subsequently been performed), the QS, NS and TS programs are loaded (step 120) and the device 10 is ready to operate in the daily use mode (118).

If a user wishes to select a different one of the amplification algorithms (Q1-Q4), the device 10 must be reset. To reset the device 10, the user opens the battery compartment door 36 with the battery in place (step 128), closes the battery compartment door while pressing the rocker switch (up or down button 34*a*-34*b*) for about 15 seconds (step 132), releases the rocker switch and opens the battery compartment door (step 134). When the device 10 is next powered on after a reset (step 100), the device 10 is in the algorithm selection mode (102).

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A hearing assistance device for enhancing hearing for a user, the device comprising:

a housing configured to be worn in, on or behind an ear of the user;

a battery compartment door disposed on the housing for holding a battery that powers the hearing assistance device, the battery compartment door having an open position in which the battery is removed from the device and the device is powered off, and a closed position in which the battery is inserted into the device and the device is powered on;

one or more microphones disposed within or on the housing;

memory disposed within the housing, the memory for storing a first audio processing program and a second audio processing program that may be used in processing digital audio signals;

a single multipurpose control device disposed within or on the housing and comprising only one up control and only one down control;

a processor disposed within the housing, the processor operable to execute the first or second audio processing programs to process the digital audio signals, the processor for executing the first audio processing program when the device is powered on by moving the battery compartment door to the closed position;

the processor for discontinuing execution of the first audio processing program and initiating execution of the second audio processing program when the up control is pressed and held for an extended period of time;

the processor for discontinuing execution of the second audio processing program and initiating execution of the first audio processing program when the down control is pressed and held for an extended period of time;

a digital-to-analog converter disposed within the housing, the digital-to-analog converter for generating output analog audio signals based on the digital audio signals;

the audio output section disposed within the housing, the audio output section for receiving and amplifying the output analog audio signals, generating audible sound based thereon, and providing the audible sound to the user;

the audio output section generating audible sound of increased volume according to a number of times the up control is tapped; and the audio output section generating audible sound of decreased volume according to a number of times the down control is tapped.

2. The hearing assistance device of claim 1 wherein the single multipurpose control device comprises a digital rocker switch.

3. The hearing assistance device of claim 1 wherein, the memory stores a third audio processing program that may be used in processing digital audio signals;

the processor for discontinuing execution of the second audio processing program and initiating execution of the third audio processing program when the up control is pressed and held for an extended period of time; and the processor for discontinuing execution of the third audio processing program and initiating execution of the second audio processing program when the down control is pressed and held for an extended period of time.

4. The hearing assistance device of claim 3 wherein the third audio processing program comprises a telecoil audio processing program configured for use when the user is listening to a telephone.

5. The hearing assistance device of claim 1 wherein a single one of the one or more microphones is used when the first audio processing program is in use, thereby providing an omnidirectional response for quiet environments, and at least two of the one or more microphones are used when the second audio processing program is in use, thereby providing an enhanced directional response for noisy environments.

6. The hearing assistance device of claim 1 wherein the audio output section generates some number of audible tones when the multipurpose control device is operated to switch from one to another of the first and second audio processing programs, wherein the number of audible tones indicates whether the first or second audio processing program is currently in use.

7. A method for controlling a hearing assistance device for enhancing hearing for a user, the hearing assistance device having a single multipurpose control device comprising an up control and a down control, and having a processor for processing digital audio signals using multiple amplification algorithms, and having an audio output section for generating audible sound, the method comprising:

(a) the user powering on the hearing assistance device;

(b) upon performance of step (a), the processor using one of the amplification algorithms;

(c) the user listening to audible sound generated by the audio output section as the processor processes the digital audio signals;

(d) while performing step (c), the user tapping the up control a number of times;

(e) upon performance of step (d), increasing the volume of audible sound generated by the audio output section according to the number of times the up control is tapped;

(f) while performing step (c), the user tapping the down control a number of times;

(g) upon performance of step (f), decreasing the volume of audible sound generated by the audio output section according to the number of times the down control is tapped;

(h) the user pressing and holding the up control or the down control for an extended period of time; and (i) upon performance of step (h), the processor discontinuing use of one of the amplification algorithms and initiating use of another of the amplification algorithms.

* * * * *